United States Patent [19]

Rossi

[11] Patent Number: 4,647,737

[45] Date of Patent: Mar. 3, 1987

[54] SNAP-ACTION SWITCH FOR ALTERNATING CURRENT

[75] Inventor: Guglielmo Rossi, Linkenheim-Hochstätten, Fed. Rep. of Germany

[73] Assignee: Ranco Incorporated, Dublin, Ohio

[21] Appl. No.: 851,884

[22] Filed: Apr. 11, 1986

Related U.S. Application Data

[63] Continuation of Ser. No. 786,713, Oct. 11, 1985, abandoned, which is a continuation of Ser. No. 529,753, Sep. 6, 1983, abandoned.

[30] Foreign Application Priority Data

Sep. 10, 1982 [DE] Fed. Rep. of Germany ..... 3233686

[51] Int. Cl.[4] ..... H01H 21/40

[52] U.S. Cl. ..... 200/67 F

[58] Field of Search ..... 200/67 F, DIG. 27, 250; 335/188

[56] References Cited

U.S. PATENT DOCUMENTS

| | | | |
|---|---|---|---|
| 2,784,275 | 3/1957 | Senn | 200/67 F |
| 3,056,001 | 9/1962 | Fichter | 200/67 F |
| 3,225,160 | 12/1965 | Barkan | 200/250 |
| 3,284,743 | 11/1966 | Spewock et al. | 200/67 F |
| 3,449,700 | 6/1969 | Gillilan | 335/188 |
| 3,991,290 | 11/1976 | Bayles et al. | 200/250 |

FOREIGN PATENT DOCUMENTS

| | | | |
|---|---|---|---|
| 112546 | 4/1975 | German Democratic Rep. . | |
| 279739 | 11/1970 | U.S.S.R. | 200/67 F |

*Primary Examiner*—James E. Bryant, III
*Assistant Examiner*—Renee S. Luebke
*Attorney, Agent, or Firm*—Watts, Hoffmann, Fisher & Heinke

[57] ABSTRACT

A snap-action switch, especially microswitch for alternating current comprises at least one stationary contact (2) on a stationary contact part (1) and at least one movable contact (4) on a movable contact part (3). In order to open the switch in the proximity of the zero crossing of the switch current, on the one contact part (1; 3) there is an electromagnet unit (8) excited by the switch current while on the other contact part (3; 1) is disposed an armature unit (12) made of ferromagnetic material which is located opposite the electromagnet unit (8).

10 Claims, 8 Drawing Figures

SNAP-ACTION SWITCH FOR ALTERNATING CURRENT

Figure 1:
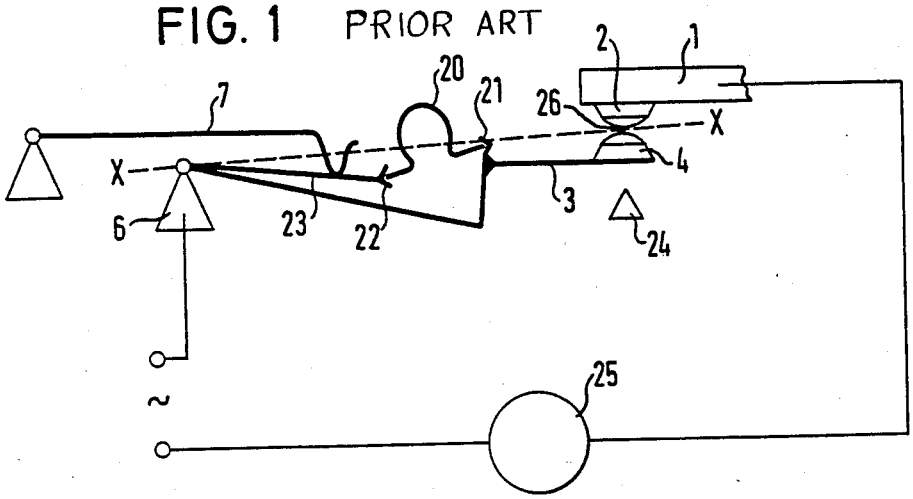
FIG. 1 PRIOR ART

This application is a continuation of application Ser. No. 786,713, filed 10/11/85, now abandoned, which is a continuation of application Ser. No. 529,753, filed 09/06/83, now abandoned.

The invention relates to a snap-action switch, for alternating current comprising at least one stationary contact on a stationary contact part and at least one movable contact part.

Switches of this type are generally subject to the problem of contact erosion which occurs as a result of bouncing of the movable contact after the switch is initially closed and due to arc formation upon opening of the switch. The greater the air gap between the contacts and the greater the current being switched the greater is the contact erosion. Contact erosion is usually accompanied by increased contact resistance between the switch contacts when closed and by R.F. noise produced when the contacts are opened and closed.

This effect has been studied and is described in IEE PROC., Vol. 128, Pt.B, No. 5, September 1981, pp 237–242.

The possibility of contact erosion has lead to the design of switches having a relatively high content of precious metals, e.g. silver, in the contacts or switches which are overdimensioned in order to have the necessary service life time.

Moreover, in most switches of the snap-action type the occurance of contact erosion alters the geometry of the switch. This manifests itself in an increased amount of displacement of the switch operating member (stroke increase) to cause the switch to cut-in and cut-off the load. In the case of switches used on control devices such as a thermostat or a pressure sensing device an alteration of the switch stroke will result in drift of temperature or pressure setting which is obviously not desirable in the application.

An important feature of the present invention is the provision of a snap-action switch for alternating current having an arrangement to synchronize the actual contact opening with the sine wave of the alternating current being switched so that the actual switched current is with safety as near as possible to zero value and in no case in the range of the maximum current flowing through the switch in its closed condition.

This object is attained by the invention in that on the one contact part an electromagnet unit excited by the switch current is arranged and on the other contact part an armature unit made of ferromagnetic material is arranged opposite said electromagnet unit.

The electromagnet unit excited by the switch current attracts the armature unit according to the magnetic flux generated by its excitation, and with a force which is proportional to the instantaneous value of the current. Thereby to the natural closing contact force of the switch is superimposed an additional closing force which is proportional to the present if a current is flowing in the switch. During zero crossing of the current, this additional closing force is zero, so that the switch can only open in the proximity of zero crossing and thus the current actually switched is certainly substantially limited to a value considerably below the maximum value of the current. With this arrangement the occurance of contact erosion is substantially reduced as well as the possibility of generating radio-interference. Furthermore, the super-imposed closing force tends to decrease the bouncing period at the closure of the contacts resulting in a further reduction of contact erosion.

This simple and cost effective arrangement leads to a switch design having either less precious metal content (e.g. silver) and/or smaller dimensions for the same rated current and life endurance expectance.

Expediently the electromagnet unit is arranged on the stationary contact part and the armature unit is arranged on the movable contact part in order to keep the masses to be moved as low as possible.

The electromagnet unit is advantageously a unit of ferromagnetic material with two pole shoes and an excitation winding through which switch current flows, disposed on the one contact part.

The electromagnet can also be a unit of ferromagnetic material with two pole shoes surrounding the one contact part, of which the one contact part itself forms the excitation winding.

The armature unit is expediently a part made of ferromagnetic material disposed on the other contact part bridging the pole shoes of the electromagnetic unit. The other contact part can itself be made of ferromagnetic material and form per se the armature unit.

When designing the switch as a change-over switch, it has expediently either two electromagnet units as well as one armature unit or one electromagnet unit as well as two armature units. Naturally in the first case the electromagnet units are stationary and the armature unit is movable, while in the latter case the armature units are stationary and the electromagnet unit is movable.

Below the invention will be further explained on the basis of the drawings. In the drawings show FIG. 1 a schematic representation of a generic snap-action switch actuated by an external member and shown in its closed position, FIG. 2 a switch as per FIG. 1 in proximity of opening the contacts, FIG. 3 a switch as per FIG. 1 showing the effect on the switch geometry at the occurance of contact erosion, FIG. 4 a schematic representation of a snap-action switch, especially microswitch, according to the invention, FIG. 5 a schematic representation of a part of a switch according to the invention with a possible embodiment of the electromagnet unit and the armature unit in side view, FIG. 6 a front view of the illustration in FIG. 5, FIG. 7 a schematic representation of a switch according to the invention formed as a change-over switch, and FIG. 8 a diagramatic representation on the switching instant seen on a sine wave of the current.

The switch shown schematically in FIG. 1 has a stationary contact part 1 with a stationary contact 2 and a movable contact part 3 carrying a movable contact 4. An omega shaped spring 20 is pivoted between hinges 21 and 22 provided on the movable contact part 3 and a resilient member 23 preloaded upwards and electrically connected to a terminal 6.

An external actuating member cooperates with the resilient member 23 to actuate the switch in its open and closed positions. A stationary stop 24 is provided to limit the amount of contact opening and defines the amount of stroke the actuating member 7 has to perform to cut-in and cut-off the switch.

An electrical load 25 is connected to the stationary contact part 1 and to an electrical supply. A pole of the electrical supply is connected to the terminal 6 thus having the load current flowing between terminal 6 and stationary contact part 1. Under these conditions the contacts 2 and 4 have a holding force maintaining them closed determined solely by a component of the omega-spring force.

The opening of the contacts occurs when the actuating member 7 in its rotation counter clock-wise and followed by the resilient member 23 puts into geometrical allignment the hinges 21 and 22 with the contact point 26.

Figure 2:
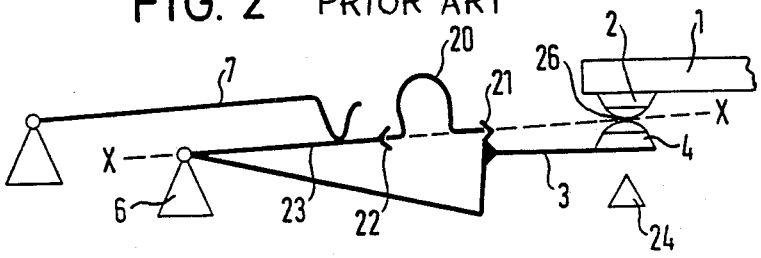
FIG. 2 PRIOR ART

Under the condition where the hinges 21 and 22 and the contact point 26 are on a line X—X the holding contact force is zeroed and the opening of the contacts 2 and 4 starts to occur under the action of the omega shaped spring 20 as shown in FIG. 2.

In the case of a control device the actuating member 7 may move very slowly depending on the rate of change of the parameter to which it is responsive to. In addition, in a multitude of applications there is no correlation in time between the switch actuating member and the load current sine wave generating therefore a switching event at any point of the sine wave.

Therefore the probability of switching when the current has a considerable value is pretty high. Conversely the probability of closing the switch in an instant at which the voltage sine wave has a considerable value is high as well. In both cases, the interruption of a high instantaneous current and closing the contacts at a high instantaneous voltage leads to possible contact erosion.

Figure 3:
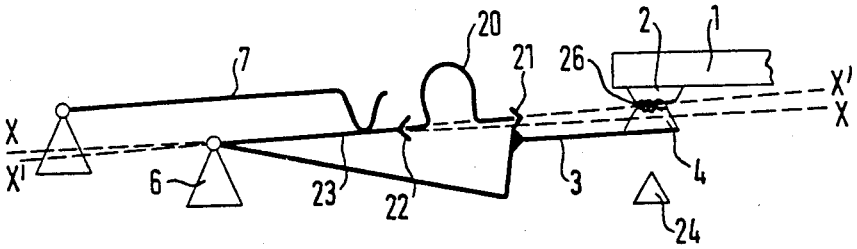
FIG. 3 PRIOR ART

In FIG. 3 it is shown the switch of FIG. 1 having the contacts 2 and 4 eroded. In this condition the geometrical allignment of the hinges 21 and 22 with the contact point 26 occurs in a different position (line X'—X') of the actuating member 7 with respect the initial condition with the contacts 2 and 4 not affected (line X—X) which will in turn generate a drift of the calibration of the control device.

Figure 4:
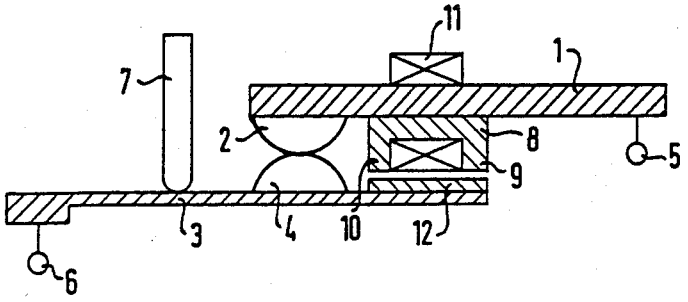

The switch, especially microswitch shown schematically in FIG. 4 has a stationary contact part 1 with a stationary contact 2 and a resilient movable contact part 3 with a rovable contact 4. The stationary contact part 1 has a terminal 5 and the movable contact part 3 has a terminal 6. An actuating member 7 is provided to actuate the switch.

On the stationary contact part 1 there is in the proximity of the contacts 2 and 4 an electromagnet unit 8 having pole shoes 9 and 10 and an excitation winding 11. The switch current being an alternating current, flowing via the terminal 5, the contact part 1, the contact 2, the contact part 3 and the terminal 6, is flowing through the excitation winding 11. On the movable contact part 3 an armature unit 12 of ferromagnetic material is disposed opposite the electromagnet unit 8. Said armature unit 12 can have the form e.g. of a chip bridging the pole shoes 9 and 10 of the electromagnet unit 8.

When the contacts 2 and 4 are closed, the switch current flows through the excitation winding 11 and the contact pressure is reinforced by the force exerted by the electromagnet unit 8 on the armature unit 12 according to the instantaneous value of the switch current.

As the actuating member 7 approaches the condition of FIG. 2, e.g. allignment of the hinges 21 and 22 and the contact point 26 on the line X—X, the contact force will be still a finite value more than zero due to the magnetic holding, thus preventing the switch to open until the zero crossing of the current.

This means that the current on switching over is never equal to the maximum instantaneous value of the switch current, but is always substantially below it. Thus the contact erosion against a switch without the electromagnet unit 8 and the armature unit 12 according to the invention is substantially reduced. Hence it follows in addition that the response inaccuracies caused by contact burning off can be prevented for longer periods and thus the service life time of the switch is substantially prolonged, other design factors being equal.

Figure 5:
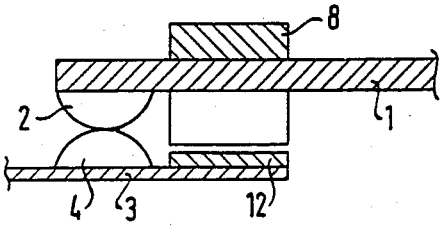
Figure 6:
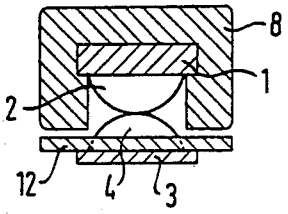

FIG. 5 and 6 show schematically a switch in which the electromagnet unit 8 is a unit surrounding the stationary contact part 1 and is made of ferromagnetic material. In this case the stationary contact part 1 itself forms the excitation winding of the electromagnet unit 8.

Of course it is also possible to dispose the electromagnet unit 8 on the movable contact part 3 and the armature unit 12 on the stationary contact part 1. Instead of disposing the armature unit 12 on the movable contact part 3 or on the stationary contact part 1, the movable contact part 3 or the stationary contact part 1 can also be themselves made of ferromagnetic material.

Figure 7:
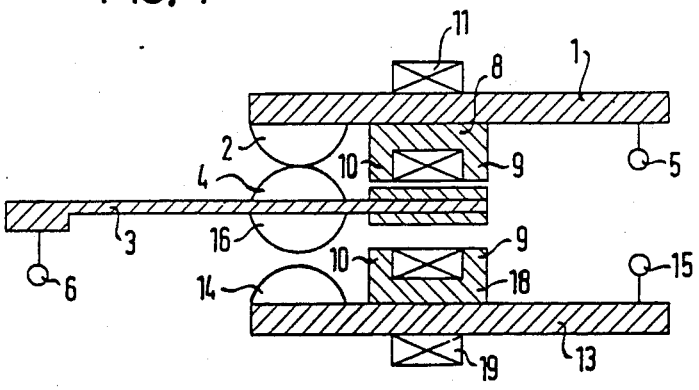

FIG. 7 shows schematically an embodiment of the inventive switch when designed as a change-over switch. Such a switch has a second stationary contact part 13 with relating stationary contact 14 which has a further terminal 15. The movable contact part 3 has a further movable contact 16.

On the stationary contact part 13 a further electromagnet unit 18 is located. The armature unit 12 is designed such that depending on the switch position it is attracted by either electromagnet unit 8 or the electromagnet unit 18. The effect of the electromagnet units 8 and 18 together with the armature unit 12 is, depending on the switch position of the switch, respectively the same as was described in connection with FIG. 4, when either the excitation winding 11 of the electromagnet unit 8 or the excitation winding 19 of the electromagnet unit 18 has the switch current passing through it.

Figure 8:
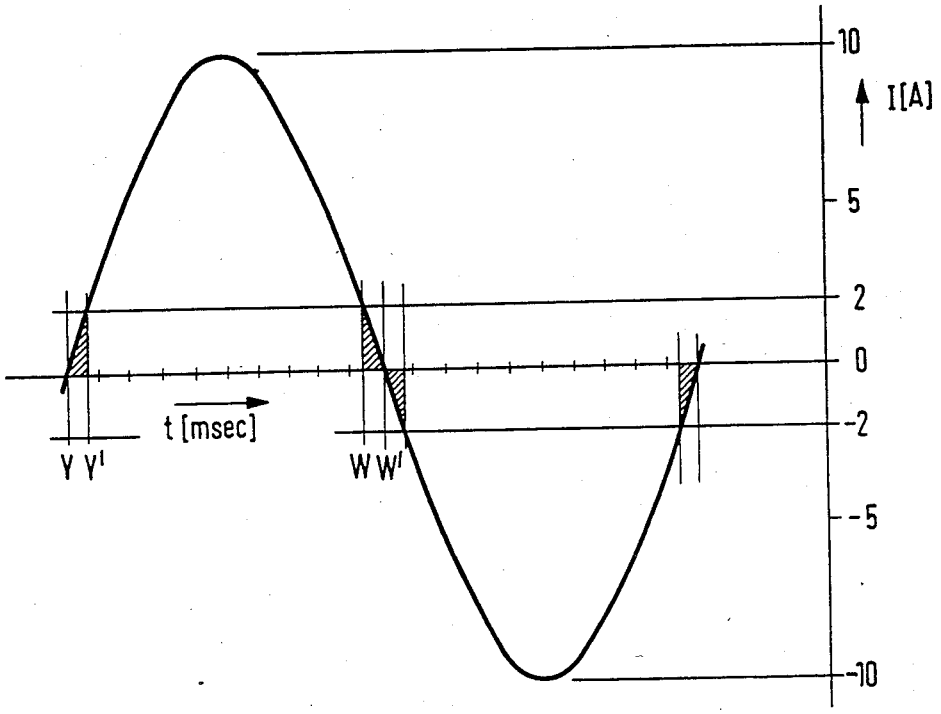

The effect of this arrangement according to the invention can be seen in FIG. 8 where a current sine wave is represented. As a matter of example the sinewave has a frequency of 50 Hz and the peak value of the current is 10 Ampere. (Effective value about 7 Ampere).

A switch without the magnetic arrangement previously described would open the contacts randomly with respect the sine wave generating an arc occuring the instant the contacts start to separate and terminating at the zero crossing of the current. Therefore, in a semiperiod the arc duration may theoretically vary from zero to 10 msec. This would average an arc duration 5 msec. at an effective value 7 Amp.

With the magnetic arrangement above described the practical assumption is made that the magnetic holding force is capable of delaying the contact opening until the current drops to about 2 Ampere, i.e. 20% of the peak current.

The actual contact opening will therefore be allowed to initiate in the time period represented by the shaded areas which is about 13% of the total sine wave period whereas for the remainder 87% the contact opening cannot occur eventhough the actuating member has achieved the position under which the switch would open if the current did not flow.

If the switch opens in time period (y–y') the arc duration will be 10 msec. maximum/9.35 msec. minimum at an instantaneous current between zero and 2 Amp. tending to increase during the arcing in dependence of the arc resistance. The average arcing duration is therefore 9.67 msec. but the incidence is 6.5% of cases. In the period y'–w no contact opening can initiate until the instant w at which the current is 2 Amp. and the arc duration will bei 0.65 msec. This represents 87% of cases. In the period w–w' the switch is allowed to open with an arc duration 0.65 msec. maximum zero msec. minimum at an instantaneous current between 2 Amp. and zero averaging an arc duration of 0.325 msec. in 6.5% of cases. The general average of arc duration will result to be 1.21 msec. at a maximum instantaneous current of 2 Amp. in 93.5% of cases which compares with 5 msec. at an instantaneous current zero/10 Amp. if a magnetic holding is not provided.

It is reasonable to concede that a contact non subjected to long arcing time and interrupting a low current is proned to an increased endurance and/or to be designed in a smaller dimension.

The magnetic arrangement of the switch according to the invention includes a possible delay of the contact opening instant for a max. of 8.7 msec. which in most of the applications is an irrelevant delay.

It is relevant to note the series of advantages the magnetic arrangement brings in Arcing energy at the contact opening considerably reduced due to the lower current interrupted. Arcing duration considerably reduced. These resulting in considerable less contact erosion.

Bouncing of the contact at the closure transient is damped by the holding magnetic force.

Possible generation of radio interference induced on the supply line and/or through air is considerable reduced.

Arrangement insensitive to the power factor as synchronized with the current sine wave.

Arrangement capable of working at different current values without requiring tuning to a specific running current.

I claim:

1. A snap-action switch for alternating current comprising:

(a) a stationary contact part supporting a stationary contact element;

(b) a movable contact part having a contact element fixedly secured thereto for movement therewith;

(c) a snapping mechanism including a snap spring member resiliently engaging said movable contact part for snap moving said movable contact part and element toward and away from said stationary contact part and element respectively;

(d) an electromagnet unit excited by current passing through said switch, said electromagnet unit mounted on one of said contact parts; and, (e) armature associated with the other of said contact parts;

(f) said electromagnet unit comprising a pole piece formed from ferromagnetic material defining:

(i) a yoke extending along a first side of said one contact part; and, (ii) two pole shoes projecting from said yoke along respective second and third sides of said one contact part toward said armature;

(iii) said one contact part itself forming a sole excitation conductor for said electromagnet unit;

(g) said armature disposed for magnetically bridging the projecting ends of said pole shoes so that said armature is magnetically coupled to said pole piece in accordance with current alternations through said switch when said contact elements are engaged so that said armature and said snapping mechanism coact in governing opening of the switch.

2. A switch according to claim 1, wherein the pole piece of said electromagnet unit is arranged on the stationary contact part and the armature is supported on the movable contact part.

3. A switch according to claim 1, wherein the armature comprises a ferromagnetic part disposed on said other contact part and bridging the pole shoes.

4. A switch according to claim 1, wherein said other contact part itself is made of ferromagnetic material and forms said armature.

5. A snap-action switch according to claim 1 wherein said stationary contact element is mounted at a projecting end of said stationary contact part, said electromagnet unit is mounted closely adjacent to said stationary contact element on said stationary contact part, said armature is mounted at a projecting end of said movable contact part, and said movable contact element is mounted closely adjacent to said armature on said movable contact part.

6. A snap-action switch according to claim 1, further comprising a second stationary contact part, said movable contact part arranged between said first and second stationary contact parts, a second electromagnet unit mounted on said second stationary contact part and said armature being mounted on said movable contact part in position for magnetic coupling with said first and second electromagnet units, respectively, depending on the positioning of said movable contact part, said movable contact part bearing a second contact element, said first and second movable contact elements engageable with said first and second stationary contact elements, respectively.

7. A snap acting switch for alternating current comprising:

(a) a movable contact part supported for snap movement about a center of motion;

(b) a contact element fixed to said contact part remote from said center of motion;

(c) actuating means for snap moving said contact part, said actuating means engaging said contact part between said contact element and said movement center;

(d) a stationary contact part disposed adjacent said movable contact part;

(e) a stationary contact element supported in position for engagement by said movable contact element for enabling said switch to conduct alternating current when said contacts are engaged;

(f) electromagnetic means for producing alternating current responsive forces between said contact parts when said contacts elements are engaged, said electromagnetic means located with respect to said movable contact part so that said movable contact element is disposed along said movable contact part between said electromagnetic means and said center of movement, said electromagnetic means comprising:

(i) a pole piece supported by one of said contact parts;

(ii) electrical conductor means coupled to said pole piece for inducing magnetic flux in said pole piece; and, (iii) an armature associated with the other of said contact parts and aligned with said pole piece so that said armature and said pole piece are magnetically couplable when said contacts are engaged.

8. A switch according to claim 7, wherein said electromagnetic means comprises two ferromagnetic pole shoes and an excitation winding through which the switch current flows.

9. A switch according to claim 7, wherein said electromagnetic means comprises two ferromagnetic pole shoes extending along said one contact part with said one contact part itself forming a sole excitation conductor for said pole shoes.

10. The switch claimed in claim 7 wherein said stationary contact part is formed at least in part by an elongate conductor supporting said stationary contact element, and said pole piece comprises first and second pole shoes disposed along sides of said conductor so that switch current flowing through said conductor induces the magnetic flux in said pole shoes for rendering said electromagnetic means effective.

* * * * *